US011114017B2

(12) United States Patent
Kim et al.

(10) Patent No.: US 11,114,017 B2
(45) Date of Patent: Sep. 7, 2021

(54) MURA CORRECTION DRIVER

(71) Applicant: Silicon Works Co., Ltd., Daejeon (KR)

(72) Inventors: Ki Taek Kim, Daejeon (KR); Jun Young Park, Daejeon (KR); Doo Hwa Jang, Daejeon (KR); Seung Wan Yu, Daejeon (KR); Do Yeon Kim, Daejeon (KR)

(73) Assignee: Silicon Works Co., Ltd., Daejeon (KR)

( * ) Notice: Subject to any disclaimer, the term of this patent is extended or adjusted under 35 U.S.C. 154(b) by 0 days.

(21) Appl. No.: 16/723,336

(22) Filed: Dec. 20, 2019

(65) Prior Publication Data

US 2020/0211442 A1 Jul. 2, 2020

(30) Foreign Application Priority Data

Dec. 26, 2018 (KR) ..... 10-2018-0169627

(51) Int. Cl.
*G09G 3/20* (2006.01)

(52) U.S. Cl.
CPC ... *G09G 3/2007* (2013.01); *G09G 2320/0233* (2013.01); *G09G 2330/10* (2013.01)

(58) Field of Classification Search
CPC ..... G09G 3/2007; G09G 2330/10; G09G 2320/0233; G09G 2320/0285; G09G 2320/0271; G09G 2320/0242; G09G 3/006; G09G 3/36; G09G 3/3208; G09G 2320/0626
See application file for complete search history.

(56) References Cited

U.S. PATENT DOCUMENTS

| | | | | |
|---|---|---|---|---|
| 10,121,408 | B2 | 11/2018 | Deng | |
| 2008/0284794 | A1* | 11/2008 | Wang | G09G 3/3688 345/618 |
| 2014/0184671 | A1* | 7/2014 | Lee | G09G 3/006 345/697 |
| 2015/0287350 | A1* | 10/2015 | Jun | G09G 3/006 345/690 |
| 2016/0247432 | A1* | 8/2016 | Hu | G09G 5/02 |
| 2018/0166030 | A1 | 6/2018 | Liu et al. | |
| 2020/0211429 | A1* | 7/2020 | Kim | G09G 3/006 |

FOREIGN PATENT DOCUMENTS

| | | | |
|---|---|---|---|
| KR | 10-1567424 | A | 5/2010 |
| KR | 10-1374989 | B | 3/2014 |
| KR | 2015-0078839 | A | 7/2015 |
| KR | 10-1747405 | B | 6/2017 |
| KR | 2017-0087566 | A | 7/2017 |
| KR | 2014-0076963 | A | 3/2019 |
| KR | 2017-0128573 | A | 11/2019 |

* cited by examiner

*Primary Examiner* — Abhishek Sarma
(74) *Attorney, Agent, or Firm* — Polsinelli PC

(57) ABSTRACT

A Mura correction driver which corrects Mura detected in a detection image obtained by photographing a display panel. The Mura correction driver uses Mura correction data including a position value of a Mura block for a display panel and coefficient values for the Mura block, and corrects display data corresponding to the position value of the Mura block, by using a Mura correction equation to which the coefficient values of the Mura block are applied.

14 Claims, 9 Drawing Sheets

MURA CORRECTION DRIVER

CROSS-REFERENCE TO RELATED APPLICATIONS

The present application claims priority to Korean Application No. 10-2018-0169627 filed Dec. 26, 2018 the contents of which are hereby incorporated by reference as set for fully herein.

BACKGROUND

1. Technical Field

Various embodiments generally relate to a Mura correction system, and more particularly, to a Mura correction driver which corrects Mura detected in a detection image obtained by photographing a display panel.

2. Related Art

Recently, LCD panels and OLED panels have been widely used as display panels.

Mura may occur in a display panel due to an error in a manufacturing process, or the like. Mura means that a display image has non-uniform luminance in the form of a spot at a pixel or a certain area. A defect that Mura occurs is referred to as a Mura defect.

The Mura defect needs to be detected and corrected to allow the display panel to have improved image quality.

SUMMARY

Various embodiments are directed to a Mura correction driver for correcting a brightness value of a Mura block or a Mura pixel of a display panel, detected based on the brightness value, by using a quadratic Mura correction equation.

Also, various embodiments are directed to a Mura correction driver capable of correcting a brightness value of a Mura block beyond a representation range of basic range bits of coefficients, by applying an adaptive range capable of changing a brightness value representation range of the Mura block, to a coefficient of a Mura correction equation.

Further, various embodiments are directed to a Mura correction driver capable of eliminating an error likely to occur in Mura correction, by applying a control value for display brightness value (DBV) control, to an input value of a Mura correction equation.

In an embodiment, a Mura correction driver may include: a Mura memory configured to store Mura correction data including a position value of a Mura block for a display panel and coefficient values for the Mura block; and a Mura correction unit configured to receive display data and the Mura correction data, set first display data corresponding to the position value of the Mura block, as a first input value of a quadratic Mura correction equation to which the coefficient values of the Mura block are applied, generate a solution of the Mura correction equation corresponding to the first input value, as first correction display data for the first display data, and output the display data including the position value of the Mura block and the first correction display data.

In an embodiment, a Mura correction driver may include: a Mura memory configured to store Mura correction data including a position value of a Mura block for a display panel and coefficient values for the Mura block; a display brightness value control unit configured to receive a control signal for display brightness value control, and provide a control value corresponding to the control signal; a Mura correction equation setting circuit configured to receive the Mura correction data, and set a Mura correction equation for a first input vale, by applying the coefficient values of the Mura block; an input value adjustment circuit configured to set a third input value by calculating the first input value and the control value, and change the Mura correction equation into an equation for the third input value; and a correction output circuit configured to generate a solution of the Mura correction equation corresponding to the third input value as first display data corresponding to the position value of the Mura block among display data is inputted as the first input value, as first correction display data for the first display data, and output the display data including the position value of the Mura block and the first correction display data.

According to the embodiments of the disclosure, by correcting a brightness value of a Mura block or a Mura pixel of a display panel detected based on the brightness value, by using a quadratic Mura correction equation, it is possible to improve the image quality of the display panel.

Also, according to the embodiments of the disclosure, as an adaptive range capable of changing a brightness value representation range of a Mura block is applied to a coefficient of a Mura correction equation, a brightness value of the Mura block may be corrected beyond a representation range of basic range bits of coefficients, whereby the image quality of a display panel may be more effectively improved.

Further, according to the embodiments of the disclosure, by applying a control value for display brightness value control, to an input value of a Mura correction equation, an error likely to occur in Mura correction by applying a quadratic Mura correction equation and an adaptive range to a coefficient may be effectively eliminated.

DETAILED DESCRIPTION

Figure 1:
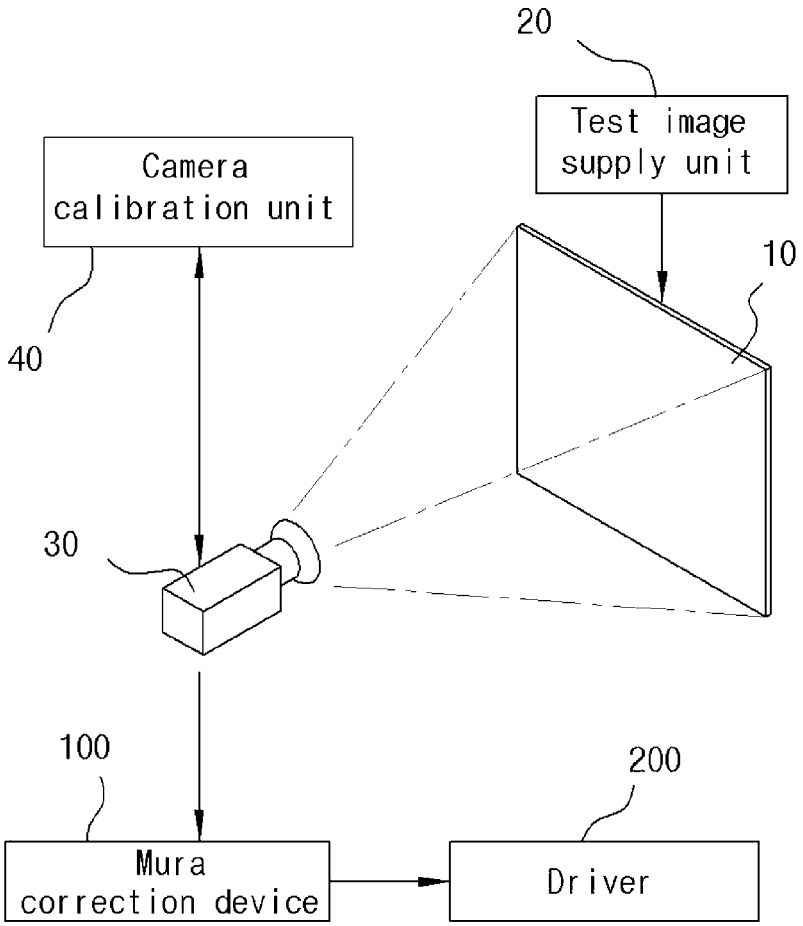
FIG. 1 is a block diagram illustrating a representation of an example of a Mura correction system in accordance with an embodiment of the disclosure.

Hereinafter, embodiments of the disclosure will be described in detail with reference to the accompanying drawings. The terms used herein and in the claims shall not be construed as being limited to general or dictionary meanings and shall be interpreted based on the meanings and concepts corresponding to technical aspects of the disclosure.

Embodiments described herein and configurations illustrated in the drawings are preferred embodiments of the disclosure, but do not represent all of the technical features of the disclosure. Thus, there may be various equivalents and modifications that can be made thereto at the time of filing the present application.

Mura in the form of a spot occurs in a pixel of a display image due to an error in a manufacturing process, or the like. The Mura defect of a display panel may be solved by accurately detecting a test image displayed on the display panel, analyzing the Mura in a detection image and correcting the Mura as a result of analyzing the Mura.

To this end, a Mura correction system in accordance with an embodiment of the disclosure may be illustrated as in FIG. 1.

Referring to FIG. 1, the Mura correction system includes a test image supply unit 20 which provides a test image for each gray level to a display panel 10, an image detection unit 30 which photographs the test image displayed on the display panel 10 and provides a photographed detection image, a camera calibration unit 40 which analyzes the detection image and thereby provides calibration information for allowing the image detection unit 30 to obtain an accurate detection image, and a Mura correction device 100 which performs Mura analysis on the detection image and generates Mura correction data corresponding to the Mura analysis. The Mura correction device 100 is configured to provide the Mura correction data to a driver 200.

In the above configuration, the display panel 10 may use an LCD panel or an OLED panel.

Figure 2A:
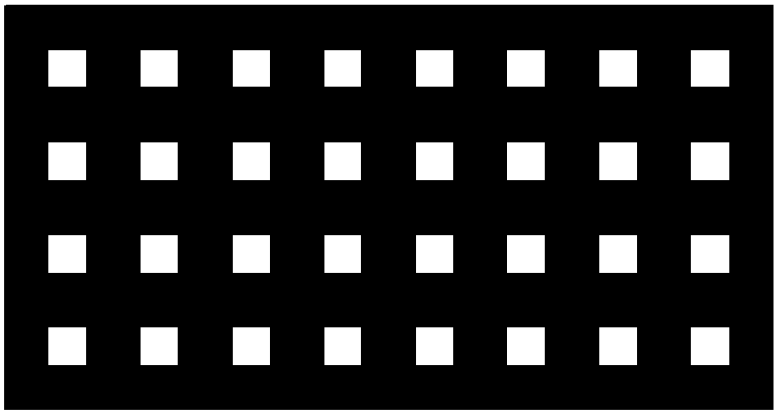
FIGS. 2A and 2B are diagrams illustrating representations of examples of test images.
Figure 2B:
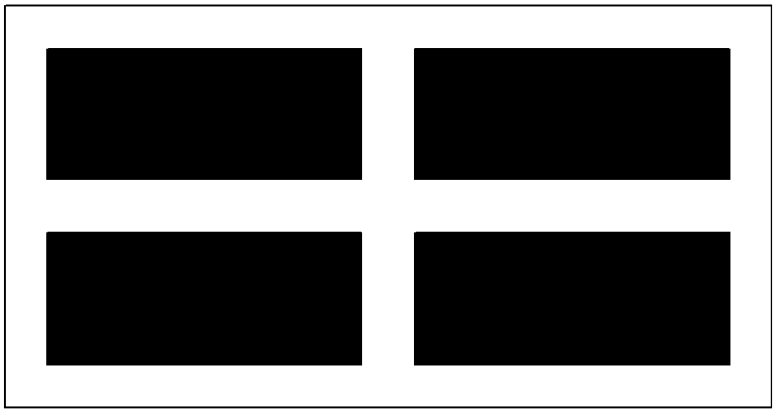

The test image supply unit 20 may provide test images as illustrated in FIGS. 2A and 2B. FIG. 2A illustrates that small square white patterns are formed in a matrix structure, and FIG. 2B illustrates that large square black patterns are formed in a matrix structure.

Unlike FIGS. 2A and 2B, a test image may be variously applied depending on the size or shape of the display panel 10. That is to say, in a test image, the shape, size, arrangement state or number of patterns may be determined depending on the size or shape of the display panel 10. Also, as the shape of the patterns included in the test image, not only a quadrangular shape but also various shapes may be applied and may be formed solely or in combination.

The test image supply unit 20 may separately provide a test image for calibrating the photographing state of the image detection unit 30 and a test image for analyzing the Mura of the display panel 10. The test image for calibrating the photographing state of the image detection unit 30 may be configured to have patterns that are easy to analyze the size, rotation and distortion of an image, and the test image for analyzing the Mura of the display panel 10 may be configured to easily obtain a pixel brightness value of the display panel 10 for each gray level. In the description of the embodiment of the disclosure, both the two cases will be collectively referred to as a test image.

The display panel 10 may receive a test image, that is, test image data, supplied from the test image supply unit 20, may drive pixels arranged in the form of a matrix depending on the test image data, and may display the test image through the driving of the pixels.

The image detection unit 30 may be understood as a camera which uses an image sensor, and obtains a detection image by photographing the test image displayed on the display panel 10, to analyze Mura. The photographing state of the image detection unit 30 may be variously set depending on the shape or size of the display panel 10. The image detection unit 30 may provide the photographed detection image, that is, detection image data, to the camera calibration unit 40 and the Mura correction device 100. The detection image data representing the detection image may be transmitted in formats corresponding to various protocols that may be received by the camera calibration unit 40 and the Mura correction device 100. In the following description, a detection image may be understood as detection image data.

The camera calibration unit 40 may be configured to display calibration information for calibrating the photographing state depending on a result of analyzing the detection image obtained by photographing the test image illustrated in FIG. 2A or 2B, on a separate display device (not illustrated) or to feed the calibration information back to the image detection unit 30.

In the case where the camera calibration unit 40 displays the calibration information on a separate display device, a user may check the calibration information and manually calibrate the photographing state of the image detection unit 30. In the case where the image detection unit 30 is configured to be able to automatically calibrate the photographing state by referring to the fed-back calibration information, the calibration of the photographing state may be automatically implemented as the camera calibration unit 40 feeds the calibration information back to the image detection unit 30.

The Mura analysis uses the detection image photographed by the image detection unit 30. Thus, the setting of the photographing state of the image detection unit 30 may exert substantial influence on a Mura analysis result.

According to the embodiment of the disclosure, by using the camera calibration unit 40 to objectively determine a case where the detection image does not maintain an original value of the test image and has a size change, rotation or distortion, the photographing state of the image detection unit 30 may be calibrated, and, through the calibration, an error that may occur by the image detection unit 30 may be reduced.

The Mura correction device 100 receives the detection image from the image detection unit 30, and performs Mura analysis on the detection image and generation of Mura correction data.

Figure 3:
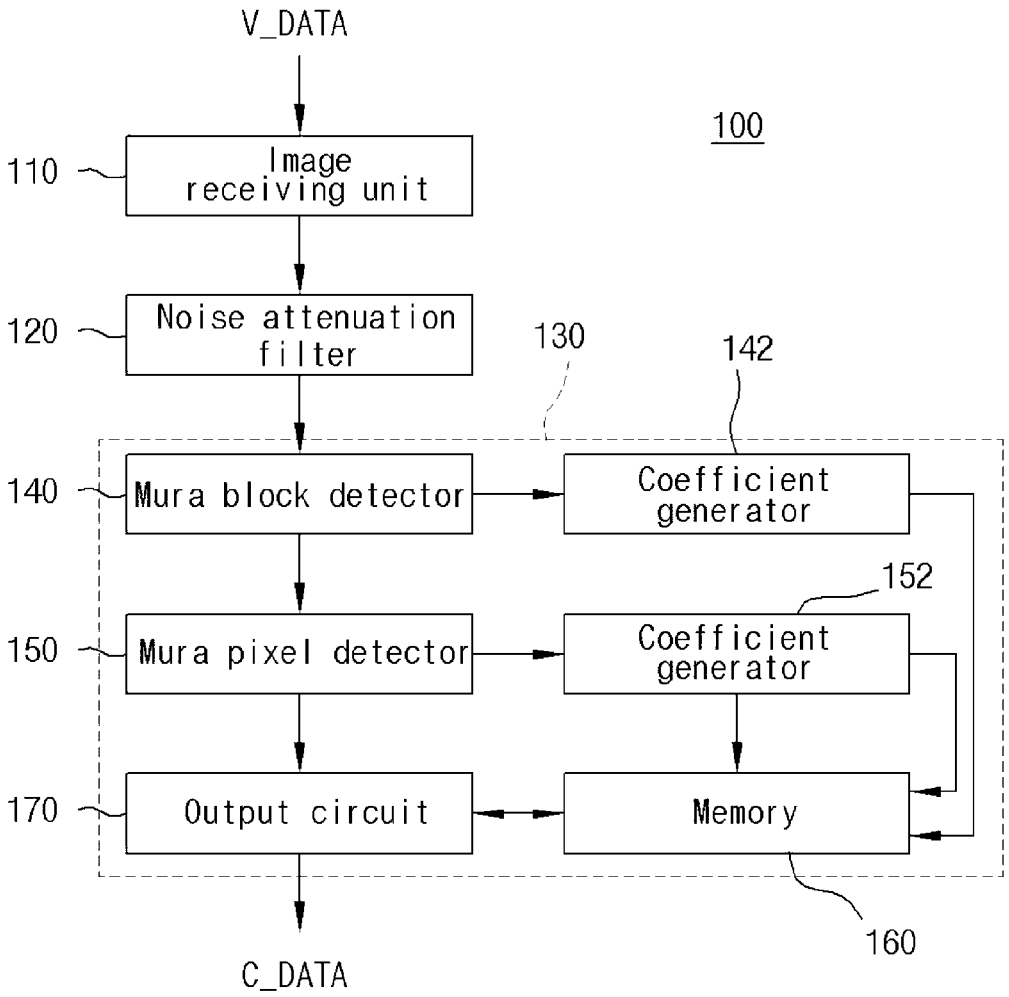
FIG. 3 is a block diagram illustrating a representation of an example of a Mura correction device of FIG. 1.

The Mura correction device 100 may be exemplified as illustrated in FIG. 3. In FIG. 3, the detection image is denoted by V_DATA, and the Mura correction data is denoted by C_DATA.

The Mura correction device 100 includes an image receiving unit 110 and a noise attenuation filter 120 which perform a preprocessing operation on the detection image V_DATA, and includes a Mura correction unit 130 for Mura correction of the preprocessed detection image V_DATA.

The image receiving unit 110 is an interface part for receiving the detection image V_DATA transmitted from the external image detection unit 30 and transmitting the received detection image V_DATA to the noise attenuation filter 120.

The noise attenuation filter 120 is to filter noise of the detection image V_DATA.

The detection image V_DATA provided from the image detection unit 30 has noise due to an electrical characteristic of the image sensor. The noise may serve as a factor that increases an error deviation in Mura analysis.

Therefore, the noise due to the electrical characteristic of the image sensor should be filtered from the detection image V_DATA. For this purpose, the noise attenuation filter 120 may be configured using a low pass filter. The low pass filter may be understood as commonly designating a Gaussian filter, an average filter, a median filter, and so forth.

The detection image V_DATA is inputted to the Mura correction unit 130 after passing through the image receiving unit 110 and the noise attenuation filter 120 for the preprocessing.

The Mura correction unit 130 receives the detection image V_DATA in which noise is attenuated by the noise attenuation filter 120, and detects a Mura block which has Mura, by determining a brightness value of each detection image V_DATA in a block unit including a plurality of pixels. The Mura correction unit 130 generates coefficient values of coefficients of a Mura correction equation as a quadratic equation for correcting a measurement value of the Mura block for each gray level to an average pixel brightness value of the display panel 10.

The Mura correction unit 130 sets a first coefficient, for example, a coefficient of the highest order, among the coefficients of the Mura correction equation to include adaptive range bits capable of changing a brightness representation range of the Mura block. The adaptive range bits are to set the coefficient value of the first coefficient such that the sum of a Mura measurement value of the Mura block and a Mura correction value approximates to the average pixel brightness value. The Mura correction unit 130 generates Mura correction data including a position value of the Mura block and the coefficient values of the coefficients of the Mura correction equation.

To this end, the Mura correction unit 130 includes a Mura block detector 140, a coefficient generator 142, a Mura pixel detector 150, a coefficient generator 152, a memory 160, and an output circuit 170.

The Mura block detector 140 receives the detection image V_DATA in which noise is attenuated by the noise attenuation filter 120, and detects a Mura block which has Mura, by determining a brightness value of each detection image V_DATA in a block unit including a plurality of pixels.

Figure 4:
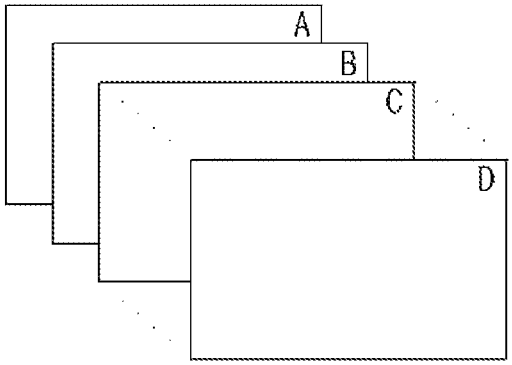
FIG. 4 is a diagram illustrating a representation of an example of detection images corresponding to test images for respective gray levels.

For example, the detection image V_DATA may be provided in frame units A, B, C, D having different gray level values, from the image detection unit 30, as illustrated in FIG. 4, and the Mura block detector 140 detects a Mura block in a block unit for each frame unit. FIG. 4 may be understood as representing frames of 18 gray levels, 48 gray levels, 100 gray levels and 150 gray levels as detection images V_DATA.

Figure 5:
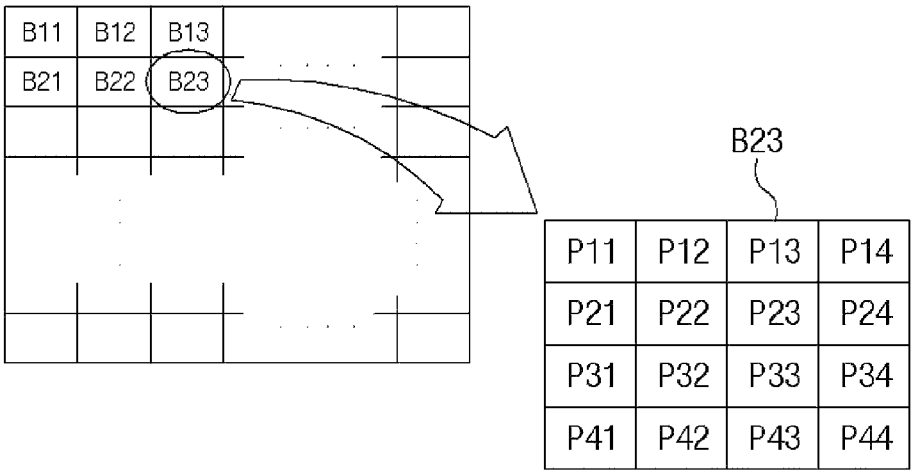
FIG. 5 is a representation of an example of a diagram to assist in the explanation of a method of analyzing a Mura block in a detection image.

For example, as illustrated in FIG. 5, the detection image V_DATA of each frame may be divided into a plurality of blocks which are arranged in the form of a matrix, and each block includes a plurality of pixels which are arranged in the form of a matrix. In FIG. 5, the reference symbols B11, B12, . . . , B23 are to separately represent respective blocks, and the reference symbols P11, P12, . . . , P44 are to separately represent respective pixels.

A Mura block may be determined in the block unit of FIG. 5. A Mura block may be determined based on an average brightness value for each gray level of the detection image V_DATA of the display panel 10. For instance, a block may have an average brightness value calculated by the brightness of the pixels included therein. Among blocks, a block having an average brightness value that deviates from a standard deviation by an average brightness value for each gray level of the display panel 10, by at least a predetermined level, may be determined as a Mura block.

The Mura block detector 140 generates a position value of a block determined as a Mura block. For example, the position value of the Mura block may be designated as a position value of a specific one of the pixels included in the Mura block. More specifically, when the block B23 of FIG. 5 is a Mura block and the coordinates of the pixel P11 of the block B23 are (5, 9), the position value of the Mura block may be designated as (5,9).

The Mura block detector 140 outputs data including the position value of the Mura block and the detection image V_DATA for the block, to the coefficient generator 142, and outputs information of the blocks for the detection image V_DATA (information including position information and the detection image V_DATA), to the Mura pixel detector 150.

The coefficient generator 142 generates coefficient values of coefficients of a Mura correction equation as a quadratic equation for correcting a measurement value of a Mura block for each gray level to an average pixel brightness value for each gray level of the display panel 10, and stores a position value of the Mura block and the coefficient values of the coefficients of the Mura correction equation in the memory 160. The position value of the Mura block and the coefficient values of the coefficients of the Mura correction equation are stored in the memory 160 to join with each other, and may be defined as Mura correction data.

In the embodiment of the disclosure, Mura correction for the Mura block is performed in the driver 200. In order for Mura correction, an approximate equation capable of accurately representing a brightness value of a Mura block for each gray level, that is, a Mura correction equation, is required. In the case where the Mura correction equation is determined, Mura correction may be accurately performed if only the coefficient values of the coefficients of the Mura correction equation for each gray level are determined.

In the embodiment of the disclosure, the Mura correction device 100 may generate the coefficient values of the Mura correction equation for Mura correction of the Mura block, as the Mura correction data. The driver 200 may have an algorithm which performs a calculation according to the Mura correction equation, and, by applying an input data (display data) to the Mura correction equation to which the coefficient values provided from the Mura correction device 100 are applied, may provide driving signals capable of displaying a screen with improved image quality in correspondence to the display data, to the display panel 10.

The disclosure is implemented to use a quadratic Mura correction equation to maximally approximate a brightness value of the Mura block for each gray level to an average pixel brightness value of the display panel 10. Therefore, the Mura correction device 100 generates the coefficient values of the coefficients of the Mura correction equation that is a quadratic equation, and the driver 200 applies the coefficient values of the coefficients to the Mura correction equation, corrects an input value (display data) by the Mura correction equation and outputs driving signals corresponding to the corrected display data.

Figure 6:
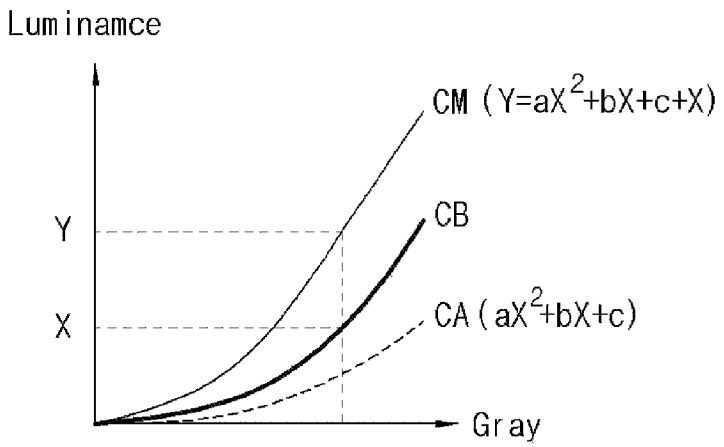
FIG. 6 is a graph illustrating a representation of an example of the relationship among a measurement value of the Mura block, a Mura correction value and an average pixel brightness value of a display panel, for each gray level.

The Mura correction equation will be described hereinbelow with reference to FIG. 6. In FIG. 6, the curve CM represents an average pixel brightness value of the display panel 10 for each gray level, the curve CA represents a Mura correction value for each gray level, and the curve CB represents a Mura measurement value for each gray level.

$$Y=aX^2+bX+c+X \quad \text{[Equation 1]}$$

In Equation 1, the Mura correction value for each gray level is expressed as $aX^2+bX+c$, the Mura measurement value for each gray level is expressed as X, and the average pixel brightness value of the display panel 10 for each gray level is expressed as Y. In Equation 1, X is the Mura measurement value for each gray level, that is, a gray level value of a gray level, and the coefficients of respective orders of the Mura correction equation are expressed as a, b and c.

Figure 7:
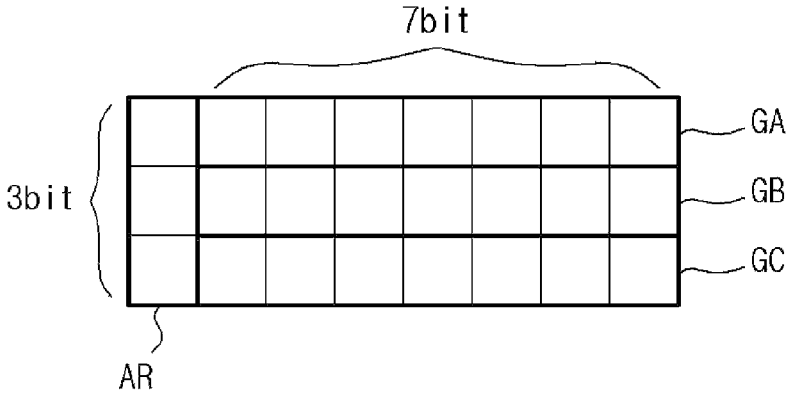
FIG. 7 is a diagram illustrating a representation of an example of a memory map which stores coefficient values of a Mura correction equation by applying an adaptive range.

In the embodiment of the disclosure, the coefficient values of the respective orders of the Mura correction equation may be stored using a memory map as illustrated in FIG. 7. The coefficients of the Mura correction equation may be set within a storage capacity range by the memory map.

Figure 8:
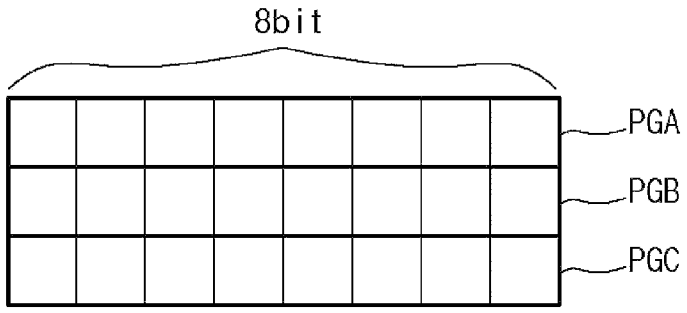
FIG. 8 is a diagram illustrating a representation of an example of a memory map which stores general coefficient values.

In a general case, the coefficient values of the respective orders of the Mura correction equation may be set to be expressed by 8 bits for example, and may be stored using a memory map as illustrated in FIG. 8. In FIG. 8, PGA denotes bits which express the coefficient value of the coefficient a, PGB denotes bits which express the coefficient value of the coefficient b, and PGC denotes bits which express the coefficient value of the coefficient c.

If a brightness value of the Mura block for each gray level does not change significantly, the coefficient values of the coefficients a, b and c may be sufficiently expressed by the 8 bits illustrated in FIG. 8. However, if a change in a brightness value of the Mura block for each gray level is substantial, it is difficult to sufficiently express the coefficient values of the coefficients a, b and c by 8 bits.

In order to solve this problem, the embodiment of the disclosure may be configured to set at least one designated coefficient among the coefficients, by applying an adaptive range. For instance, in order to solve the above-described problem of FIG. 8, the embodiment of the disclosure is configured to set the coefficient a of the highest order among the coefficients, by applying an adaptive range, as illustrated in FIG. 7.

Referring to FIG. 7, the coefficient a of the highest order among the coefficients is set to include adaptive range bits AR and basic range bits GA, and the remaining coefficients b and c are set to include basic range bits GB and GC. The basic range bits GA, GB and GC of the coefficients a, b and c may be set to have the same number of bits. The adaptive range bits AR are exemplified as 3 bits, and the basic range bits GA, GB and GC are exemplified as 7 bits.

On the other hand, the basic range bits GA, GB and GC of the respective coefficients may be set to have different numbers of bits. In other words, the number of the basic range bits GA of the coefficient a may be set to m1, the number of the basic range bits GB of the coefficient b may be set to m2, the number of the basic range bits GC of the coefficient c may be set to m3, and the number of the adaptive range bits AR may be set to n. Here, m1, m2, m3 and n are natural numbers.

Namely, the total capacity of the memory map is m1+m2+m3+n bits. In the total capacity, the remaining bits except m1+n bits allocated to the coefficient a may be allocated to express the basic range bits GB and GC of the coefficients b and the coefficient c. For instance, the coefficient a may be set to have the adaptive range bits AR of 2 bits (n=2) and the basic range bits GA of 7 bits (m1=7), the coefficient b may be set to have the basic range bits GB of 7 bits (m2=7), and the coefficient c may be set to have the basic range bits GC of 8 bits (m3=8).

The adaptive range bits AR described above are to change a brightness representation range of the Mura block so that the sum of the Mura measurement value of the Mura block and the Mura correction value approximates the average pixel brightness value. The brightness representation range of the Mura block determined by the change of the value of the adaptive range bits AR includes a resolution and a brightness value range. That is to say, the change of the adaptive range bits AR changes the brightness representation range, the resolution and the brightness value range of the Mura block.

In the embodiment of the disclosure, the coefficient a may be changed by changing the adaptive range bits AR. In other words, in the case where a change in the brightness value of the Mura block is substantial and thus a value of the Mura correction equation does not reach the average pixel brightness value of the display panel 10 through setting of the basic range bits of the coefficients a, b and c, the coefficient value of the coefficient a may be changed by changing the adaptive range bits AR. By the setting of the adaptive range bits AR, the coefficient a may have a coefficient value that is most approximate to an actually required coefficient value in the brightness representation range of the Mura block.

A method of setting the coefficient a of the Mura correction equation according to the embodiment of the disclosure to which an adaptive range is applied will be described below with reference to FIG. 9.

The coefficient a is expressed by the adaptive range bits AR and the basic range bits GA. In the case where the adaptive range bits AR are 3 bits, the coefficient a may have a value corresponding to a representation range of 8 steps, such as Range0 to Range7.

Figure 9:
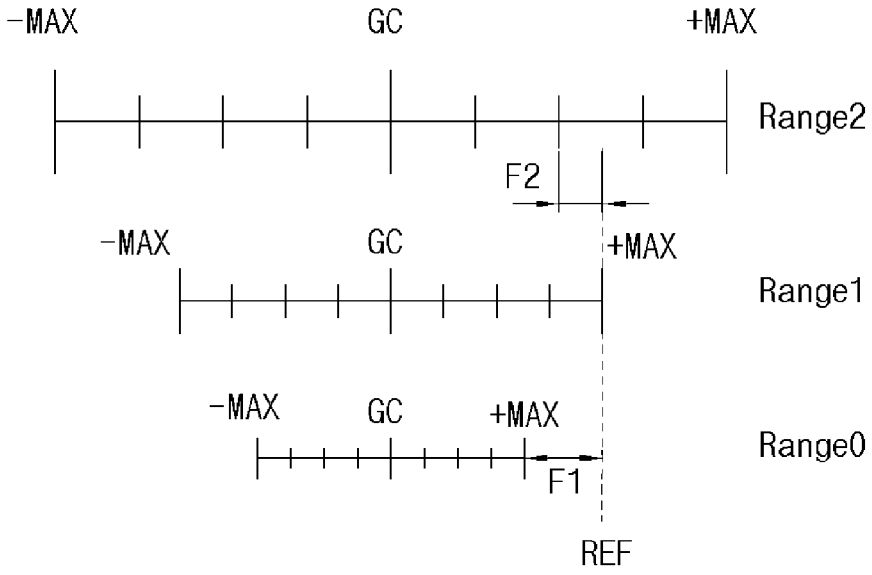
FIG. 9 is a representation of an example of a diagram to assist in the explanation of a method for obtaining an actually required coefficient by changing a representation range of the brightness value of a Mura block.

FIG. 9 illustrates that the brightness representation range of the Mura block is changed to Range0, Range1 and Range2, wherein the brightness representation range of the Mura block is narrowest in Range0 and is widest in Range2.

As the adaptive range bits AR have a higher value, the brightness representation range of the Mura block becomes wider. Namely, the brightness value range of the Mura block becomes wider, and the resolution of the Mura block becomes lower.

Table 1 shows the changes in the adaptive range bits AR of the coefficient a to represent 256 gray levels.

TABLE 1

| AR | −MAX~+MAX | Range of brightness value | Resolution |
|---|---|---|---|
| 0 | $-2^{-8}$~$2^{-8}$ | $2*2^{-8}$ | $(2*2^{-8})/256$ |
| 1 | $-2^{-9}$~$2^{-9}$ | $2*2^{-9}$ | $(2*2^{-9})/256$ |
| 2 | $-2^{-10}$~$2^{-10}$ | $2*2^{-10}$ | $(2*2^{-10})/256$ |

In Table 1, in the case where the adaptive range bits AR of the coefficient a are 3 bits, the value $(000)_2$ of the adaptive range bits AR is represented as 0 and corresponds to Range0 of FIG. 9, the value $(001)_2$ of the adaptive range bits AR is represented as 1 and corresponds to Range1 of FIG. 9, and the value $(010)_2$ of the adaptive range bits AR is represented as 2 and corresponds to Range2 of FIG. 9.

As in Table 1, when the value of the adaptive range bits AR is changed, the representation ranges, the brightness value ranges and the resolutions of the Range0, Range1 and Range 2 are changed as the value of the adaptive range bits AR becomes higher.

In the foregoing, Range0 corresponds to a maximum that may be represented by the basic range bits GA of the coefficient a.

In the case where the coefficient a is set to the representation range Range0 and a coefficient value REF that is actually required to approximate to the average pixel brightness value deviates from the representation range Range0 as illustrated in FIG. 9, an error F1 occurs.

In order to eliminate the error F1, in the embodiment of the disclosure, the value of the adaptive range bits AR may be changed.

In the case where the adaptive range bits AR have the value of 2, the average pixel brightness value that may be represented by the actually required coefficient value REF is included in the representation range Range2. However, an error F2 occurs between the average pixel brightness value that may be represented by the actually required coefficient value REF and a most approximate value among values that may be represented by the gray level values of representation range Range2.

In the case where the adaptive range bits AR have the value of 1, the average pixel brightness value that may be represented by the actually required coefficient value REF is included in the representation range Range1. The average pixel brightness value that may be represented by the actually required coefficient value REF corresponds to a maximum value +MAX of the representation range Range1.

In the case of FIG. 9 and Table 1 described above, according to the embodiment of the disclosure, the value of the adaptive range bits AR may be set to 1, and the coefficient a may have a coefficient value that is obtained by combining the value of the adaptive range bits AR corresponding to 1 and the maximum value of the basic range bits GA.

In the embodiment of the disclosure, the coefficient a of the Mura correction equation may be set as in the method described above with reference to FIG. 9 and Table 1.

In the case where a value that exactly corresponds to the desired coefficient value REF does not exist among the representation ranges corresponding to the changes of the adaptive range bits AR, the coefficient a may have a coefficient value that is obtained by combining the value of the adaptive range bits AR corresponding to a representation range in which a most approximate value exists and the maximum value of the basic range bits GA.

As described above, the coefficient generator 142 first determines the coefficient values of the coefficients a, b and c of the Mura correction equation by using the basic range bits GA, GB and GC. In the case where an average pixel brightness value for each gray level of the display panel 10 deviates from a value range by the Mura correction equation, the adaptive range bits AR of the coefficient a of the highest order are set such that the actually required coefficient value REF has a value most approximate to the average pixel brightness value.

When the coefficient values of the coefficients of the Mura correction equation for the Mura block are generated as described above, the coefficient generator 142 stores the position value of the Mura block and the coefficient values of the coefficients of the Mura correction equation, in the memory 160, as the Mura correction data. The position value of the Mura block and the coefficient values of the coefficients of the Mura correction equation are stored in the memory 160 in the form of a lookup table. The position value of the Mura block is utilized as an index. The position value of the Mura block and the coefficient values of the coefficients of the Mura correction equation are joined with each other such that the coefficient values of the coefficients of the Mura correction equation may be read from the position value of the Mura block.

In the Mura correction unit 130, as described above, the Mura block detector 140 detects the Mura block and thereby generates the position value of the Mura block, and the coefficient generator 142 generates the coefficient values of the coefficients of the Mura correction equation.

Thereafter, the Mura block detector 140 may output the detection image V_DATA to the Mura pixel detector 150 in a frame unit or a block unit. The Mura block detector 140 outputs the information of blocks for the detection image V_DATA of a general block and the Mura block (information including position information and the detection image V_DATA), to the Mura pixel detector 150.

A Mura pixel means a pixel which has a defect, and indicates a dot-shaped Mura having a pixel size that occurs due to an error in a manufacturing process, or the like.

The Mura pixel may be determined in a block unit of the detection image V_DATA. The Mura pixel may be detected based on the average pixel brightness value of the display panel 10 and a brightness value of an adjacent pixel.

More specifically, in the case where a brightness value of a Mura pixel such as a white dot Mura, a black dot Mura, and a black and white dot Mura is equal to or greater than a reference value set based on an average pixel brightness value, a brightness value of an adjacent pixel or both the average pixel brightness value and the brightness value of an adjacent pixel, the corresponding pixel is detected as a Mura pixel.

Figure 10:
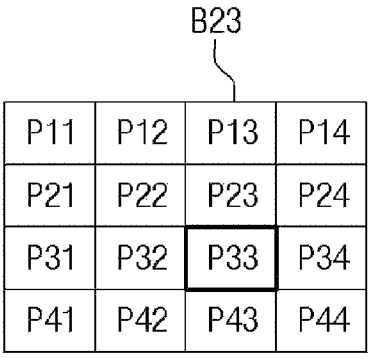
FIG. 10 is a representation of an example of a diagram to assist in the explanation of a method for detecting a Mura pixel in a block.

For instance, as illustrated in FIG. 10, the block B23 includes a plurality of pixels which are arranged in the form of a matrix.

In the block B23 of FIG. 10, a pixel having a brightness value equal to or greater than a reference value may be determined as a Mura pixel. FIG. 10 illustrates that the pixel P33 is determined as a Mura pixel.

The Mura pixel detector 150 generates a position value for the Mura pixel. In FIG. 10, in the case where the coordinates of the pixel P11 are (5, 9), the coordinates (7, 11) of the Mura pixel P33 may be generated as the position value.

The Mura pixel detection unit 150 may output data including the position value of the Mura pixel and the detection image V_DATA for the Mura pixel, to the coefficient generator 152, and may output the Mura block position value transferred from the Mura block detector 140 and the self-generated Mura pixel position value, to the output circuit 170.

The coefficient generator 152 generates coefficient values of coefficients of a Mura pixel correction equation as a quadratic equation for correcting a measurement value of the Mura pixel for each gray level to an average pixel brightness value, generates Mura pixel correction data including the position value of the Mura pixel and the coefficient values of the coefficients of the Mura pixel correction equation, and outputs the Mura pixel correction data to the memory 160.

In the embodiment of the disclosure, Mura correction for the Mura pixel is performed in the driver 200. In the same manner as the Mura correction for the Mura block, Mura correction for the Mura pixel requires an approximate equation capable of accurately representing a brightness value of the Mura pixel for each gray level, that is, the Mura pixel correction equation. In the case where the Mura pixel correction equation is determined, Mura correction for the Mura pixel may be accurately performed if only the coefficient values of the coefficients of the Mura pixel correction equation for each gray level are determined.

In the embodiment of the disclosure, the Mura correction device 100 may generate the coefficient values of the Mura pixel correction equation for Mura correction of the Mura pixel, as the Mura pixel correction data. The driver 200 may have an algorithm which performs a calculation according to the Mura pixel correction equation, and, by applying an input data (display data) to the Mura pixel correction equation to which the coefficient values provided from the Mura correction device 100 are applied, may provide driving signals capable of displaying the Mura pixel with improved image quality, to the display panel 10.

The disclosure is implemented to use the Mura pixel correction equation as a quadratic equation to maximally approximate a brightness value of the Mura pixel for each gray level to the average pixel brightness value of the display panel 10. Therefore, the Mura correction device 100 generates the coefficient values of the coefficients of the Mura pixel correction equation that is a quadratic equation, and the driver 200 applies the coefficient values of the coefficients to the Mura pixel correction equation, corrects an input value (display data) by the Mura pixel correction equation and outputs driving signals corresponding to the corrected display data to the Mura pixel.

The coefficient values of the coefficients of the Mura pixel correction equation for the Mura pixel may be generated in the same method as the coefficient values of the coefficients of the Mura correction equation.

In addition, setting the coefficient a of the highest order among the coefficients of the Mura pixel correction equation by applying an adaptive range may be configured in the same method as the Mura correction equation.

The highest-order coefficient of the Mura pixel correction equation for the Mura pixel may be set to include adaptive range bits capable of changing a brightness representation range of the Mura pixel such that the sum of a Mura measurement value of the Mura pixel and a Mura correction value approximates to the average pixel brightness value.

As such, the coefficients of the Mura correction equation and the Mura pixel correction equation may have the same format and may be set in the same method. Therefore, the detailed description of a method for generating the coefficient values of the coefficients of the Mura pixel correction equation will be omitted herein.

By the above descriptions, the memory 160 may store the Mura correction data including the position value of the Mura block and the coefficient values of the coefficients of the Mura correction equation provided from the coefficient generator 142 and the Mura pixel correction data including the position value of the Mura pixel and the coefficient values of the coefficients of the Mura pixel correction equation provided from the coefficient generator 152.

If the Mura block detection by the Mura block detector 140 and the Mura pixel detection by the Mura pixel detector 150 are completed, the output circuit 170 receives, from the memory 160, the Mura correction data corresponding to the position value of the Mura block transferred from the Mura block detector 140 and the Mura pixel correction data corresponding to the position value of the Mura pixel transferred from the Mura pixel detector 150, and provides the Mura correction data and the Mura pixel correction data to the driver 200.

The driver 200 stores the Mura correction data and the Mura pixel correction data in a storage location such as a flash memory configured therein.

The display panel 10 tested by the above-described method may be fabricated as a set with the driver 200 which stores therein the Mura correction data and the Mura pixel correction data. The driver 200 may correct display data for the Mura block or the Mura pixel by using the Mura correction data and the Mura pixel correction data.

As a result, the display panel 10 may display a screen with improved image quality by the correction of the display data.

More specifically, an embodiment of the driver 200 will be described hereinbelow with reference to FIG. 11. Hereunder, the driver 200 may be understood as a Mura correction driver.

The driver 200 is configured to include a Mura memory 210, a Mura correction unit 220, and a display brightness value (DBV) control unit 240. An embodiment of the driver 200 is exemplified as being configured to include a timing controller 230 and a signal driving unit 250. According to the embodiment of the disclosure, the Mura memory 210, the Mura correction unit 220 and the DBV control unit 240 may be embodied in various applications for Mura correction of display data, and these applications may not include the timing controller 230 and the signal driving unit 250.

The signal driving unit 250 may include a data latch 260, a digital-analog converter (DAC) 270, a gamma circuit 280, and a driving circuit 290.

The timing controller 230 receives display data of the Mura correction unit 220 in which Mura correction of a Mura block and a Mura pixel is performed. The timing controller 230 is configured to provide the display data to the data latch 260 of the signal driving unit 250 after the display data goes through an internal process such as protocol change of the display data for signal transmission.

The signal driving unit 250 is configured to receive the display data and provide a source signal Sout corresponding to the display data to the display panel 10 connected to the driving circuit 290.

The data latch 260 may be configured to include a plurality of latch elements which latch display data corresponding to one line of the display panel 10 to simultaneously process the display data.

The gamma circuit 280 is configured to provide gamma voltages for respective gray levels to the DAC 270.

The DAC 270 is configured to receive the display data of the data latch 260, select a gamma voltage of a gray level corresponding to the display data among the gamma voltages of the gamma circuit 280, and output a selected driving voltage to the driving circuit 290.

The driving circuit 290 is an output buffer for driving the output of the DAC 270 and thereby outputting the source signal Sout. The source signal Sout of the driving circuit 290 is provided to the display panel 10.

The embodiment of the driver 200 according to the disclosure corrects a brightness value of a Mura block included in display data, by using a quadratic Mura correction equation, and to this end, includes the Mura memory 210 and the Mura correction unit 220. The driver 200 may correct a brightness value of a Mura pixel included in the display data, by using a quadratic Mura pixel correction equation, and the memory 210 and the Mura correction unit 220 may also be used to correct the Mura pixel.

The Mura memory 210 stores Mura correction data including a position value of the Mura block for the display panel 10 and coefficient values for the Mura block, and Mura pixel correction data including a position value of the Mura pixel for the display panel 10 and coefficient values for the Mura pixel. The Mura correction data C_DATA of the Mura memory 210 may be understood to be provided from the Mura correction device 100 described above, and may also be understood as the Mura pixel correction data.

The Mura block, the position value of the Mura block, the Mura pixel and the position value of the Mura pixel may be understood as described above with reference to FIG. 5. Further, the Mura correction equation, the coefficient values of the coefficients of the Mura correction equation, the Mura pixel correction equation, and the coefficient values of the coefficients of the Mura pixel correction equation may be understood as described above with reference to FIGS. 6 to 9.

Among the coefficients of the Mura correction equation described above with reference to FIG. 5, the coefficient a having a highest order further includes adaptive range bits AR in comparison with the other coefficients, as described above.

The driver 200 may perform Mura correction on the Mura block, by using the position value of the Mura block and the Mura correction data of the Mura memory 210. Moreover, the driver 200 may perform Mura correction on the Mura pixel, by using the position value of the Mura pixel and the Mura pixel correction data of the Mura memory 210.

First, a configuration and operation of the driver 200 for Mura correction on the Mura block will be described below.

The Mura correction unit 220 receives the Mura correction data C_DATA of the Mura memory 210 and display data D_DATA. It may be understood that the display data D_DATA is provided to the driver 200 from an external data source, for the display of a screen.

The Mura correction unit 220 sets display data (first display data) corresponding to the position value of the Mura block among the display data D_DATA, as a first input value X of the Mura correction equation. The Mura correction equation is one to which the coefficient values of the Mura correction data C_DATA for the Mura block are applied. The Mura correction equation may be understood as $Y=aX^2+bX+c+X$ as in Equation 1.

The Mura correction unit 220 sets the coefficient a among the coefficients of the Mura correction equation to include the adaptive range bits AR and the basic range bits GA as in FIG. 7, and sets the remaining coefficients b and c to include the basic range bits GB and GC as in FIG. 7. The adaptive range bits AR may be set to have a value corresponding to a representation range having a value most approximate to the actually required coefficient value a by changing representation ranges of the basic range bits GA, GB and GC.

The Mura correction unit 220 generates a solution of the Mura correction equation corresponding to the first input value X, as first correction display data for the first display data, and outputs display data including the position value of the Mura block and the first correction display data, to the timing controller 230.

Figure 11:
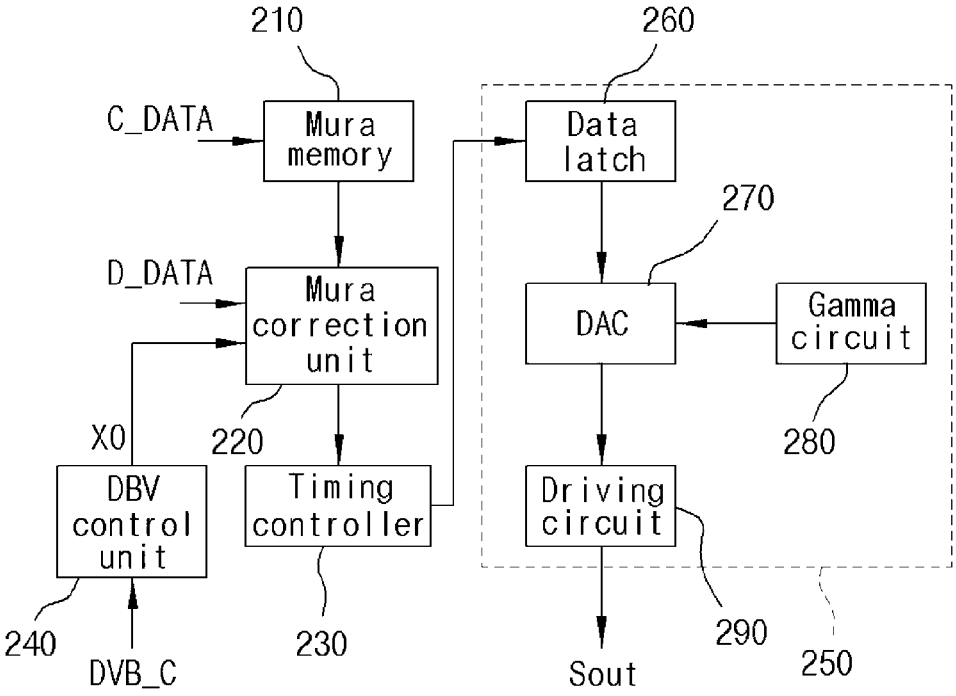
FIG. 11 is a block diagram illustrating a representation of an embodiment of a driver illustrated in FIG. 1.

Meanwhile, the Mura correction unit 220 is connected with the DBV control unit 240 for a DBV control function, as illustrated in FIG. 11.

The DBV control unit 240 receives a control signal DBV_C for DBV control, and provides a control value X0 corresponding to the control signal DBV_C to the Mura correction unit 220. The control signal DBV_C is an electrical signal which is provided from outside the driver 200 to eliminate an error likely to occur in the Mura correction, and may have a level whose value is changed within a predetermined range. The control value X0 may have a value corresponding to the level of the control signal DBV_C. The operation of the Mura correction unit 220 corresponding to the control value X0 will be described below with reference to FIG. 12.

Figure 12:
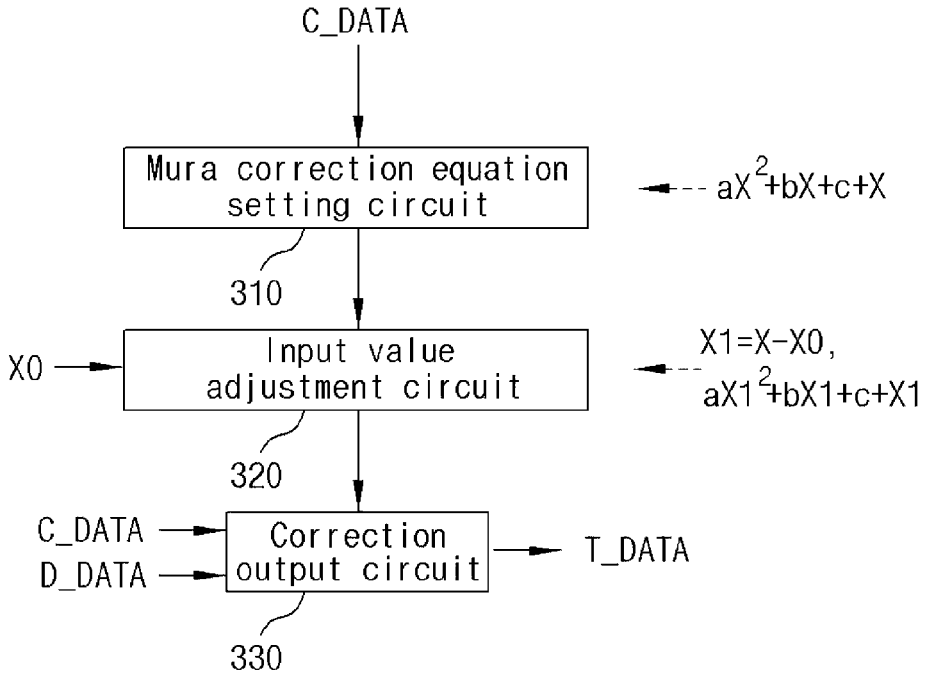
FIG. 12 is a block diagram illustrating a representation of an embodiment of a Mura correction unit illustrated in FIG. 11.

The Mura correction unit 220 may be configured as illustrated in FIG. 12 to perform Mura correction and DBV control on the Mura block.

Referring to FIG. 12, the Mura correction unit 220 includes a Mura correction equation setting circuit 310, an input value adjustment circuit 320, and a correction output circuit 330.

The Mura correction equation setting circuit 310 receives the Mura correction data C_DATA, and sets the Mura correction equation for the first input value X by applying the coefficient values of the Mura block. The Mura correction equation may be understood as $Y=aX^2+bX+c+X$ as in Equation 1.

The input value adjustment unit 320 sets a third input value X1 by calculating the first input value X and the control value X0 for DBV control, and changes the Mura correction equation to an equation for the third input value X1. That is to say, the third input value X1 may be understood as $X1=X-X0$, and the Mura correction equation is changed to an equation for the third input value X1 like $Y=aX1^2+bX1+c+X1$.

The calculation of the first input value X and the control value X0 may be selected as one of summing and multiplying the first input value X and the control value X0. In the embodiment of the disclosure, the calculation may be understood as summing the first input value X and the negative control value −X0.

The correction output circuit 330 may generate a solution of the Mura correction equation corresponding to the third input value set by substituting the first display data of the Mura block among the display data D_DATA to the first input value X, as first correction display data for the first display data, and outputs display data T_DATA including the position value of the Mura block and the first correction display data.

For instance, assuming that the value of the coefficient a is 0.1, the value of the coefficient b is 1 and the value of the coefficient c is 0, in the case where the first input value X is 100, the Mura correction value of the Mura correction equation 0.1(100)2+1(100)+0, that is, 1100.

In the above case, in the case where the input value becomes dark by 5 in terms of DBV, the third input value X1 is calculated as $X1=100-5=95$, and the Mura correction value of the Mura correction equation becomes 0.1(95)2+1(95)+0, that is, 997.5.

Figure 13:
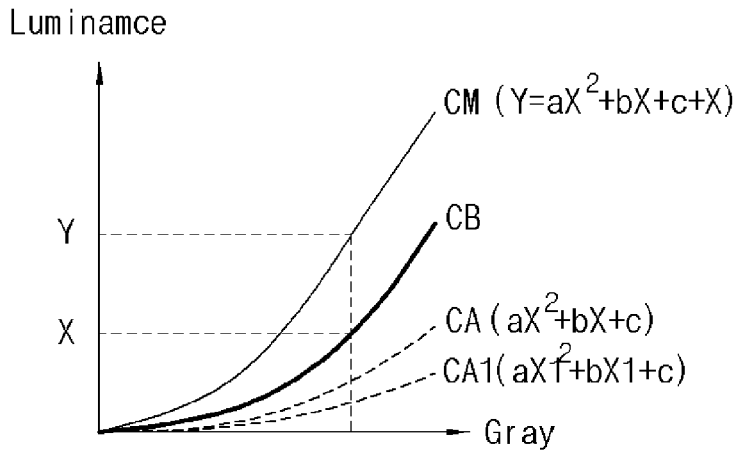
FIG. 13 is a representation of an example of a graph to assist in the explanation of a change in a Mura correction value when DBV control is applied.

As described above, according to the embodiment of the disclosure, the Mura correction value of the Mura correction equation may be changed as depicted in FIG. 13, and accordingly, the brightness value Y by the Mura correction may be changed by an amount by which the input value becomes dark.

However, in the case where the general offset control is applied, only the value of c is changed in the Mura correction equation $Y=aX1^2+bX1+c+X1$. In this case, the Mura correction value of the Mura correction equation may be changed as depicted in FIG. 14.

In the case where the input value becomes dark by 5 in the offset control, the Mura correction value of the Mura correction equation becomes 0.1(100)2+1(100)+(0-5), that is, 1095. In other words, in the case of the general offset control, when considered in terms of brightness value Y by Mura correction, a change in the Mura correction value does not correspond to that the input value becomes dark.

Figure 14:
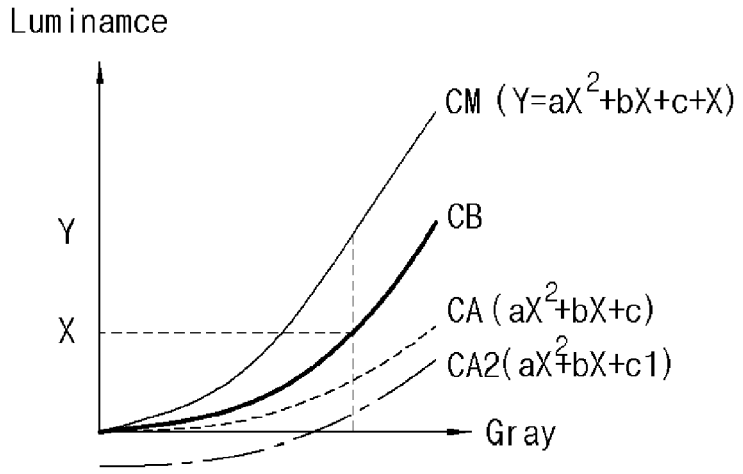
FIG. 14 is a representation of an example of a graph to assist in the explanation of a change in a Mura correction value when offset control is applied.

As can be seen from the comparison of FIGS. 13 and 14 described above, the embodiment of the disclosure may accurately correct an error likely to occur in Mura correction by applying the quadratic Mura correction equation and the adaptive range to a coefficient, by DBV control.

The Mura correction on the Mura pixel by the driver 200 may be performed in substantially the same method as the above-described Mura correction on the Mura block, except that the position value of the Mura pixel and the Mura pixel correction data of the Mura memory 210 are used.

Namely, the Mura correction unit 220 receives the Mura pixel correction data, sets display data (second display data) corresponding to the position value of the Mura pixel, as a second input value X of the quadratic Mura pixel correction equation to which coefficients for the Mura pixel are applied. The Mura pixel correction equation is one to which the coefficient values of the Mura pixel correction data for the Mura pixel are applied. The Mura pixel correction equation may be understood as $Y=aX^2+bX+c+X$ as in Equation 1.

The Mura correction unit 220 generates a solution of the Mura pixel correction equation corresponding to the second input value, as second correction display data for the second display data, and outputs display data including the position value of the Mura pixel and the second correction display data, to the timing controller 230.

In the embodiment of the disclosure, first Mura correction on the Mura pixel and second Mura correction on the Mura block may be performed sequentially.

In this case, the Mura correction unit 220 corrects the display data by the second correction display data for the second display data, by performing the first Mura correction on the Mura pixel, and then, performs the second Mura correction on the Mura block.

The Mura correction unit 220 corrects the display data with the first correction display data for the first display data, by the second Mura correction, and outputs display data for which the first Mura correction and the second Mura correction are completed, to the timing controller 230.

As is apparent from the above descriptions, according to the embodiments of the disclosure, by correcting a brightness value of a Mura block or a Mura pixel of a display panel through using a quadratic Mura correction equation, it is possible to drive the display panel to have high image quality.

Also, according to the embodiments of the disclosure, a brightness value representation range of the Mura block may be changed by applying an adaptive range to a coefficient of the Mura correction equation, and as a result, the brightness value of the Mura block may be corrected beyond a representation range of basic range bits of coefficients, whereby the image quality of the display panel may be more effectively improved.

Further, according to the embodiments of the disclosure, an error likely to occur in Mura correction may be effectively eliminated by DBV control.

While various embodiments have been described above, it will be understood to those skilled in the art that the embodiments described are by way of example only. Accordingly, the disclosure described herein should not be limited based on the described embodiments.

What is claimed is:

1. A Mura correction driver comprising:

a Mura memory configured to store Mura correction data including a position value of a Mura block for a display panel and coefficient values for the Mura block; and a Mura correction unit configured to receive display data and the Mura correction data, set first display data corresponding to the position value of the Mura block, as a first input value of a quadratic Mura correction equation to which the coefficient values of the Mura block are applied, generate a solution of the Mura correction equation corresponding to the first input value, as first correction display data for the first display data, and output the display data including the position value of the Mura block and the first correction display data, wherein the Mura memory, stores the position value of the Mura block which has Mura as a result of determining a brightness value in a block unit of a detection image for each gray level of the display panel, and stores the coefficient values of coefficients of the Mura correction equation for correcting a measurement value of the Mura block for each gray level to an average pixel brightness value of the display panel by using the Mura correction equation.

2. The Mura correction driver according to claim 1, wherein the Mura memory stores a first coefficient of the coefficients of the Mura correction equation to further include adaptive range bits in comparison with the other coefficients.

3. The Mura correction driver according to claim 1, wherein the Mura correction unit sets the Mura correction equation expressed as a sum of a Mura correction value $aX^2+bX+c$ and a Mura measurement value X, inputs the coefficient values of the Mura block to a, b and c as coefficients of the Mura correction equation, and inputs the first input value to X.

4. The Mura correction driver according to claim 3, wherein the Mura correction unit, sets the coefficient a to include adaptive range bits and basic range bits, sets the coefficient b and the coefficient c to include basic range bits, with remaining bits except bits expressing the coefficient a among entire bits of a memory map, and sets a value of the adaptive range bits to have a value corresponding to a representation range including the coefficient a most approximate to a brightness value of the Mura block which deviates a representation range of the basic range bits.

5. The Mura correction driver according to claim 1, wherein the Mura memory further stores Mura pixel correction data including a position value of a Mura pixel for the display panel and coefficient values for the Mura pixel, and wherein the Mura correction unit further receives the Mura pixel correction data, sets second display data corresponding to the position value of the Mura pixel, as a second input value of a quadratic Mura pixel correction equation to which the coefficient values for the Mura pixel are applied, generates a solution of the Mura pixel correction equation corresponding to the second input value, as second correction display data for the second display data, and includes the second correction display data in the position value of the Mura pixel of the display data.

6. The Mura correction driver according to claim 5, wherein the Mura correction unit generates the first correction display data by using the display data including the second correction display data.

7. The Mura correction driver according to claim 1, further comprising:

a display brightness value control unit configured to receive a control signal for display brightness value control, and provide a control value corresponding to the control signal, to the Mura correction unit, wherein the Mura correction unit sets a third input value by calculating the first input value and the control value, changes the Mura correction equation into an equation for the third input value, and generates a solution of the Mura correction equation corresponding to the third input value set by substituting the first display data to the first input value, as first correction display data for the first display data.

8. The Mura correction driver according to claim 7, wherein the Mura correction unit generates the third input value by summing or multiplying the first input value and the control value.

9. The Mura correction driver according to claim 7, wherein the Mura correction unit comprises:

a Mura correction equation setting circuit configured to receive the Mura correction data, and set the Mura correction equation for the first input vale, by applying the coefficient values of the Mura block;

an input value adjustment circuit configured to set the third input value by calculating the first input value and the control value for display brightness value control, and change the Mura correction equation into an equation for the third input value; and a correction output circuit configured to generate a solution of the Mura correction equation corresponding to the third input value set by substituting the first display data to the first input value, as first correction display data for the first display data, and output the display data including the position value of the Mura block and the first correction display data.

10. A Mura correction driver comprising:

a Mura memory configured to store Mura correction data including a position value of a Mura block for a display panel and coefficient values for the Mura block;

a display brightness value control unit configured to receive a control signal for display brightness value control, and provide a control value corresponding to the control signal;

a Mura correction equation setting circuit configured to receive the Mura correction data, and set a Mura correction equation for a first input vale, by applying the coefficient values of the Mura block;

an input value adjustment circuit configured to set a third input value by calculating the first input value and the control value, and change the Mura correction equation into an equation for the third input value; and a correction output circuit configured to generate a solution of the Mura correction equation corresponding to the third input value as first display data corresponding to the position value of the Mura block among display data is inputted as the first input value, as first correction display data for the first display data, and output the display data including the position value of the Mura block and the first correction display data.

11. The Mura correction driver according to claim 10, wherein the Mura memory, stores the position value of the Mura block which is determined to have Mura as a result of determining a brightness value in a block unit of a detection image for each gray level of the display panel, and stores the coefficient values of coefficients of the Mura correction equation for correcting a measurement value of the Mura block for each gray level to an average pixel brightness value of the display panel by using the Mura correction equation.

12. The Mura correction driver according to claim 10, wherein the Mura memory stores a first coefficient of the coefficients of the Mura correction equation to further include adaptive range bits in comparison with the other coefficients.

13. The Mura correction driver according to claim 10, wherein the Mura correction equation setting circuit sets the Mura correction equation expressed as a sum of a Mura correction value $aX^2+bX+c$ and a Mura measurement value X, inputs the coefficient values of the Mura block to a, b and c as coefficients of the Mura correction equation, and X is the first input value.

14. The Mura correction driver according to claim 13, wherein the Mura correction unit, sets the coefficient a to include adaptive range bits and basic range bits, sets the coefficient b and the coefficient c to include basic range bits, with remaining bits except bits expressing the coefficient a among entire bits of a memory map, and sets a value of the adaptive range bits to have a value corresponding to a representation range including the coefficient a most approximate to a brightness value of the Mura block which deviates a representation range of the basic range bits.

* * * * *